United States Patent [19]

Muramatsu

[11] Patent Number: 4,864,368

[45] Date of Patent: Sep. 5, 1989

[54] COPYING MACHINE HAVING A SHEET CONTAINER

[75] Inventor: Hideo Muramatsu, Osaka, Japan

[73] Assignee: Minolta Camera Kabushiki Kaisha, Osaka, Japan

[21] Appl. No.: 151,629

[22] Filed: Feb. 2, 1988

[30] Foreign Application Priority Data

Feb. 3, 1987 [JP] Japan ..... 62-24305

[51] Int. Cl.[4] ..... G03G 15/00

[52] U.S. Cl. ..... 355/309; 271/3.1; 271/164; 271/171; 271/259; 271/265; 355/319; 355/23

[58] Field of Search ..... 355/3 SH, 24, 14 SH, 355/26, 23; 271/171, 162, 163, 164, 3.1, 226, 259, 265

[56] References Cited

U.S. PATENT DOCUMENTS

| | | | |
|---|---|---|---|
| 3,645,615 | 2/1972 | Spear, Jr. | 355/3 |
| 3,989,371 | 11/1976 | Valentine | 355/14 |
| 4,017,173 | 4/1977 | Komori et al. | 355/8 |
| 4,123,155 | 10/1978 | Hubert | 355/26 |
| 4,173,410 | 11/1979 | Tabata et al. | 355/24 |
| 4,231,566 | 11/1980 | Suzuki | 271/164 X |
| 4,243,313 | 1/1981 | Masuda et al. | 355/3 SH X |
| 4,253,759 | 3/1981 | Rattin | 355/14 SH |
| 4,365,886 | 12/1982 | Murakami et al. | 355/3 SH |
| 4,537,497 | 8/1985 | Masuda | 355/14 R |
| 4,568,169 | 2/1986 | Wada et al. | 355/3 SH |
| 4,575,227 | 3/1986 | Ito et al. | 355/56 |
| 4,582,417 | 4/1986 | Yagasaki et al. | 355/7 |
| 4,585,336 | 4/1986 | Tanaka | 355/3 SH |
| 4,657,239 | 4/1987 | Ikesue et al. | 271/277 |
| 4,702,589 | 10/1987 | Ito | 355/14 SH |
| 4,721,382 | 1/1988 | Ito et al. | 355/14 SH |
| 4,743,945 | 5/1988 | Ito et al. | 355/14 SH |
| 4,745,439 | 5/1988 | Hanada et al. | 271/3.1 X |
| 4,772,007 | 9/1988 | Kashimura | 271/171 X |

FOREIGN PATENT DOCUMENTS

| | | | |
|---|---|---|---|
| 54-109445 | 8/1979 | Japan . | |
| 58-43480 | 3/1983 | Japan . | |
| 59-38760 | 3/1984 | Japan . | |
| 2089771 | 4/1982 | United Kingdom | 271/171 |

*Primary Examiner*—A. T. Grimley
*Assistant Examiner*—Robert Beatty
*Attorney, Agent, or Firm*—Burns, Doane, Swecker & Mathis

[57] ABSTRACT

A sheet container employed in duplex or composite copying can be drawn out of the body of the copying machine. The sheet container comprises a regulating plate for aligning the copy papers contained therein. The regulating plate has a home position and can be set at a position corresponding to the size of the copy paper. When the sheet container is drawn out of the copying machine due to a jamming or the like and thereafter attached again to the body, the regulating plate is once returned to the home position and thereafter set at a position corresponding to the size of the copy paper for the re-starting of the copying operation.

11 Claims, 9 Drawing Sheets

COPYING MACHINE HAVING A SHEET CONTAINER

BACKGROUND OF THE INVENTION

1. Field of the Invention

The present invention relates to a sheet container such as a sheet re-feeding device of a duplex/composite copy for containing/aligning sheets transported from the image forming portion of an image forming device, or a finisher and the like for binding sheets.

2. Description of the Prior Art

Recently, various sheet re-feeding devices are provided which temporarily contain a copy paper with an image formed on one side and thereafter re-feed the same to an image forming portion for obtaining a duplex copy or a composite copy. In such sheet re-feeding device, a regulating plate can be automatically set at a position corresponding to the size of the copy paper in order to align the contained copy paper.

However, in such device, when a paper jamming or the like occurs and the sheet re-feeding device is opened, the regulating plate may be moved erroneously or on purpose by the operator in removing the jammed paper. Generally, the regulating plate is driven by a stepping motor. However, the modulating ratio of the gear mechanism is not very large and there is no locking mechanism, so that it can be easily moved by an external force. Therefore, there is a possibility of starting a copying operation with the regulating plate moved from the normal position, in which case the sheet may not be contained properly, or may not be fed properly, causing jamming, skew and so on.

U.S. Pat. No. 4,123,155 discloses a copy machine for duplex copy in which a duplex copy mode is automatically selected if a sheet exists in an intermediate tray when the power is turned on. The operator can override the automatically set duplex copy mode and when overridden, the sheet in the intermediate tray is discharged out of the machine without any image formed thereon (see column 5, lines 34 to 55).

U.S. Pat. No. 4,657,239 discloses a sheet aligning device applied to an intermediate tray used in, for example, duplex copying machine.

Japanese Patent Laying-Open Gazette No. 38760/1984 discloses a duplex copying machine in which the copy mode is changed from duplex to one side if a sheet is remaining in an intermediate tray and when the copy switch is turned on, the remaining sheet is discharged.

U.S. Pat. No. 4,702,589 discloses a duplex copying machine provided with an intermediate tray having a sheet aligning means.

U.S. Pat. Nos. 4,365,886 and 4,568,169 disclose a duplex copying machine with an intermediate tray detachable to the body.

However, any of the above described patents do not disclose resetting of the aligning mechanism when the intermediate tray is attached, nor the discharging of the remaining sheet in the tray in response to the attachment.

SUMMARY OF THE INVENTION

A main object of the present invention is to provide a copying machine in which troubles such as jamming or skew in the sheet re-feeding device do not occur even in such cases that the sheet re-feeding device for carrying out duplex copying or composite copying is drawn out from the body of the copying machine and thereafter attached again.

Another object of the present invention is to provide a sheet container which ensures the alignment of the sheets with images formed thereon even in such cases that the sheet container for containing the sheets with images formed thereon in the image forming device is attached or detached.

In order to attain the above described objects, the copying machine in accordance with the present invention comprises, in a broad way, sheet feeding means for feeding sheets, image forming means for forming an image on a sheet fed from the sheet feeding means, re-feeding means for re-feeding sheets to the image forming means including a mounting plate for receiving a sheet with an image formed thereon by the image forming means, a regulating plate having an initial position and regulation the position of the sheet mounted on the mounting plate, a moving mechanism for moving the regulating plate to a position corresponding to the size of the sheet and a re-feeding mechanism for re-feeding the sheet on the mounting plate to the image forming means, a frame for holding at least the re-feeding means, a drawing mechanism for freely drawing the re-feeding means from the frame, first detecting means for detecting the size of the sheet fed from the sheet feeding means, first control means for controlling the moving mechanism in response to the detected output of the first detecting means, second detecting means for detecting the drawing and attachment of the re-feeding means by the drawing mechanism, and second control means for controlling the moving mechanism in such a manner that it returns the regulating plate once to the initial position in response to the attachment detection output of the re-feeding means by the second detecting means and thereafter moves the plate to the position corresponding to the sheet size.

In another aspect, the copying machine of the present invention is provided with a power switch which serves as the above described drawing mechanism and second detecting means.

In a further aspect, the copying machine of the present invention comprises sheet feeding means for feeding sheet, image forming means for forming an image on a sheet fed by the sheet feeding means, re-feeding means for receiving the sheet with an image formed thereon by the image forming means for re-feeding the same to the image forming means, a frame for holding at least the re-feeding means, drawing means for freely drawing the re-feeding means from the frame, first detecting means for detecting the existence of the sheet in the re-feeding means, second detecting means for detecting the drawing and attachment of the re-feeding means by the drawing means and discharging means for discharging the sheet in the re-feeding means out of the frame in response to the detecting output of the attachment of the re-feeding means by the second detecting means and to the output of the first detecting means indicating the existence of the sheet.

In the copying apparatus structured as described above, even when the re-feeding device is re-attached after the drawing, or when the power is turned on again after maintenance, the regulating plate is set again at the position corresponding to the sheet size independent on whether the regulating plate is moved or not, so that jamming or skew of the sheet does not occur in the re-copying.

In a broad way, the sheet container in accordance with the present invention comprises sheet mounting means for mounting a sheet, sheet regulating means having an initial position, regulating the position of the sheet mounted on the sheet mounting means, and being freely movable to the positions corresponding to the size of a sheet contained, driving means for moving the sheet regulating means to the position corresponding to the size of the sheet contained, detecting means for detecting the attachment/detachment of the sheet container to the image forming device, and control means for controlling the driving means in such a manner that it returns the sheet regulating means once to the initial position and thereafter moves the same to a position corresponding to the sheet size in response to the detection output of the attachment of the sheet container by the detecting means.

In addition, the sheet container in accordance with the present invention is provided with, in a further aspect, power supply means which is equivalent to the above described detecting means.

In the sheet container structured as described above, when the sheet container is attached to/detached from the image forming device or when the power is turned on again after maintenance, the regulating plate is again set at a position corresponding to the sheet size independent on whether the regulating plate is moved or not, so that the sheet with images formed thereon can be surely aligned.

These objects and other objects, features, aspects and advantageous of the present invention will become more apparent from the following detailed description of the present invention when taken in conjunction with the accompanying drawings.

DESCRIPTION OF THE PREFERRED EMBODIMENTS

One embodiment of the sheet container in accordance with the present invention will be hereinafter described with reference to the appended figures. In this embodiment, the present invention is applied as a re-feeding device for duplex/composite copying contained in the copying machine.

Figure 1:
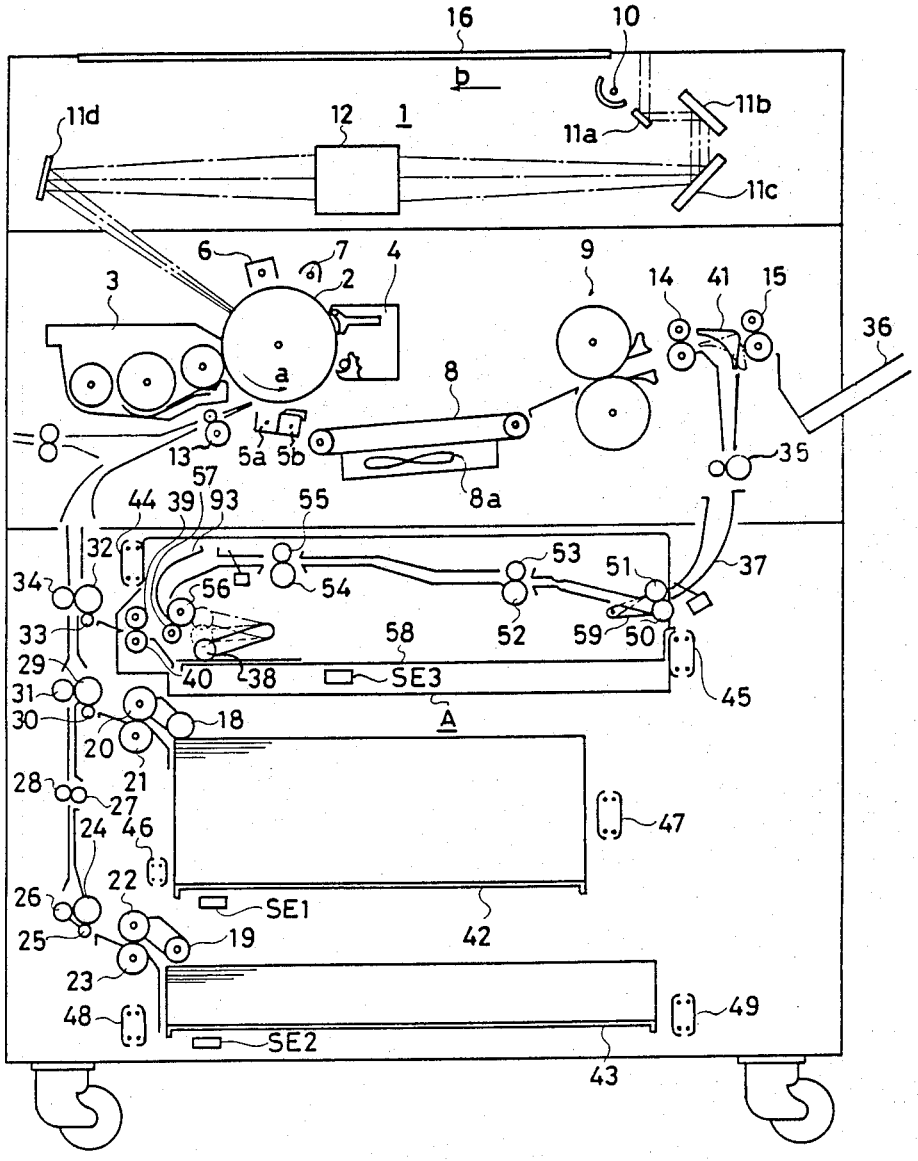
FIG. 1 shows the whole structure of a copying machine comprising the re-feeding device in accordance with one embodiment of the present invention.

First, the whole structure of the copying machine as well as the copying operation will be described with reference to FIG. 1.

The copying machine comprises a copy paper container and a sheet feeding portion in a lower section, an intermediate tray unit A directly above the copy paper container, an image forming portion mainly consist of a photoreceptor drum 2 in the intermediate section and optical system 1 in the upper section and is capable of composite copying and duplex copying by re-feeding a copy paper with an image copied on one side thereof into the intermediate tray unit A.

The said photoreceptor drum 2 is rotatable in the direction of an arrow "a" and, a corona charger 6, a magnetic brush type developing device 3, transfer charger **5*a*, separation charger 5*b*, a blade type cleaning device 4, and an eraser 7 are arranged successively therearound. The photoreceptor drum 2 is uniformly charged by the corona charger 6 in accordance with the rotation in the direction of the arrow "a", an image is exposed by the optical system 1 and a latent electrostatic image is formed, and the latent electrostatic image is developed to a toner image by the developing device 3**.

The optical system 1 is capable of scanning in the direction of an arrow "b" below the original glass plate 16, the system being constituted by a light source 10, movable mirrors **11*a*, 11*b* and 11*c*, an imaging lens 12 and a fixed mirror 11*d*. The light source 10 and the movable mirror 11*a* move integrally in the direction of the arrow "b" at the speed V/m (m: copying magnification) with the peripheral speed of the photoreceptor drum 2 being V (which is constant regardless of the equal scale magnification or variable scale magnification) and movable mirrors 11*b* and 11*c*** integrally move in the direction of the arrow "b" at the speed V/2 m.

The copy paper container comprises an upper stage container 42 of elevator type and a lower stage container 43, both of which are capable of being drawn from the body of the copying machine in the front direction by rails 46, 47 and rails 48, 49, respectively. SE1 and SE2 are sensors for detecting the size of a copy paper contained in the container 42 and 43. Either one of the copy paper in the container 42 or the copy paper in the container 43 is selectively delivered one by one by the delivering rollers 20, 21 and 22, 23 by the rotation of the feeding roller 18 and the rotation of the feeding roller 19, respectively. Then, the paper is transported through the transporting rollers 29, 30, 31, 24, 25, 26 and 32, 34, 27, 28 to the timing roller pair 13. The copy paper is temporarily stopped at the timing roller pair 13 and thereafter fed to the transfer portion in synchronization with the image formed on the said photoreceptor drum 2. By the discharge of the transfer charger **5*a*, the said toner image is transferred onto the copy paper and the paper is separated from the surface of the said photoreceptor drum 2 by the discharge of the separating charger 5*b* and fed to the fixing device 9 by a transport belt 8 provided with an air suction means 8*a*** where the toner image is fixed.

There are a transport roller pair 14 and a discharge roller pair 15 provided directly after the outlet of the fixing device 9 and a lever 41 for switching the transport path of the copy paper is provided therebetween. If the copy paper should be discharged directly, the lever 41 is set at the position shown by the chain-dotted line in FIG. 1 and the copy paper transported from the fixing device 9 is discharged on a tray 36 from the discharge roller pair 15. When a duplex copy or a composite copy is required, the lever 41 is set at a position shown by the solid line, and the copy paper is fed into the intermediate tray unit A which will be described in detail in the following through the transport roller pair 35 and a guiding plate 37.

Meanwhile, as for the photoreceptor drum 2 after the transfer operation, the remaining toner on the drum is removed by the cleaning device 4 and the remaining charges on the drum are removed by the illumination of the eraser lamp 7 to be ready for the next copying operation.

The schematic structure of the intermediate tray unit A will be hereinafter described with reference to FIGS. 1 to 5.

Figure 2:
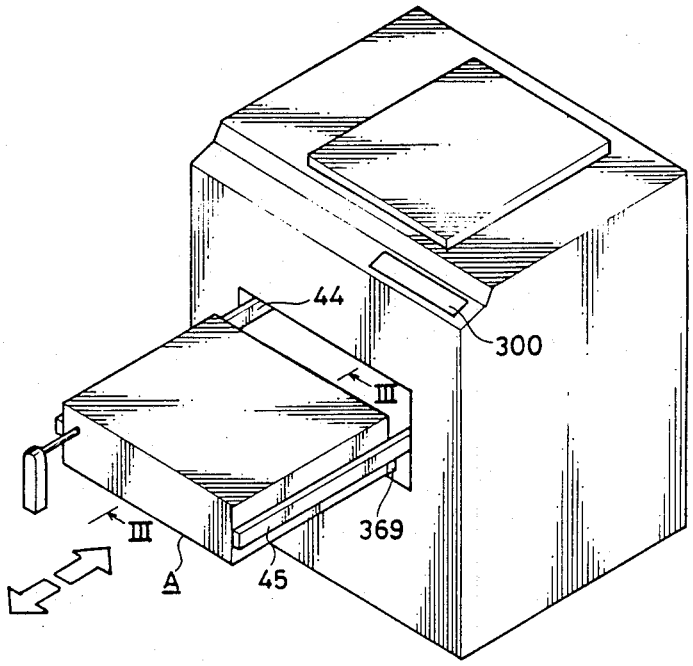
FIG. 2 is a perspective view with the intermediate tray unit of FIG. 1 drawn out.

The intermediate tray unit A comprises a switching block I, a transport block II, a reversing block III, an alignment-intermediate tray block IV and a paper re-feeding block V and forms an integral unit as a whole. The unit is supported at both ends by the rails 44 and 45, and, as shown in FIG. 2, it can be drawn out from the body of the copying machine in the front side, namely, the orthogonal direction to the transport path of the copy paper. A detection switch 369 is provided on the side of the unit A. This switch 369 turns on when the unit A is set and turns off when the unit is drawn out. SE3 provided on the bottom of the unit A in FIG. 1 is the sensor for detecting the presence/absence of a copy paper in the unit A.

The unit A is made drawable from the body of the copying machine in order to facilitate various maintenance and so on.

The switching block I is constituted by transport rollers 50 and 51 and a switching lever 59. This block I may be provided on the body of the copying machine rather than on the intermediate tray unit A.

The transport block II comprises transport rollers 52, 53 and 55 and guiding plates 201, 202, 203 and 204 and it can be opened upward with the supporting axis 95 as a fulcrum when the unit A is drawn forward. This block II is made openable upward in order to facilitate the treatment of jamming in the unit A and so on.

The reversing block III is constituted by reversing transport rollers 56 and 57 and reversing guiding plate 93 and has a function of reversing and feeding the copy paper transported in the transport block II to the intermediate tray 58.

The alignment-intermediate tray block IV is constituted by an intermediate tray 58 and regulating plates 62, 63 and 64 and 65 and has a function of aligning the copy paper fed in the intermediate tray 58. The details of the regulating plates 62, 63, 64 and 65 will be described afterwards.

The re-feeding block V comprises a holder 66, re-feeding roller 38, delivering rollers 39 and 40, and a guiding plate 88 and it re-feeds the copy papers aligned on the said intermediate tray 58 one by one.

Figure 6:
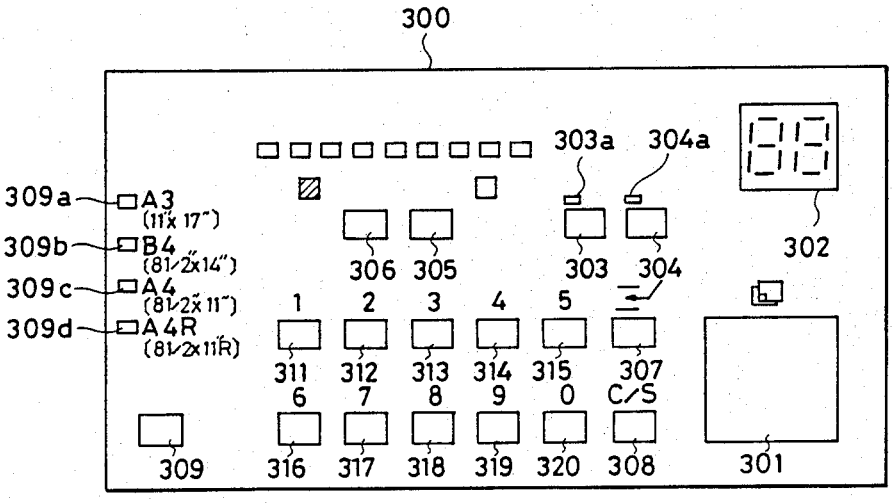
FIG. 6 is a plan view of an operation panel concerning the copying machine of the present invention.

For duplex copying and for composite copying, either one of the copying modes are selected by previously pressing the selection keys 303 and 304 on the operating panel 300 shown in FIG. 6. When the copying operation is started, the said switching lever 41 is switched to the position shown by the solid line in FIG. 1 and a copy paper with an image copied on one side is guided from the transport roller pair 35 through the guiding plate 37 to the transport rollers 50 and 51.

Figure 3:
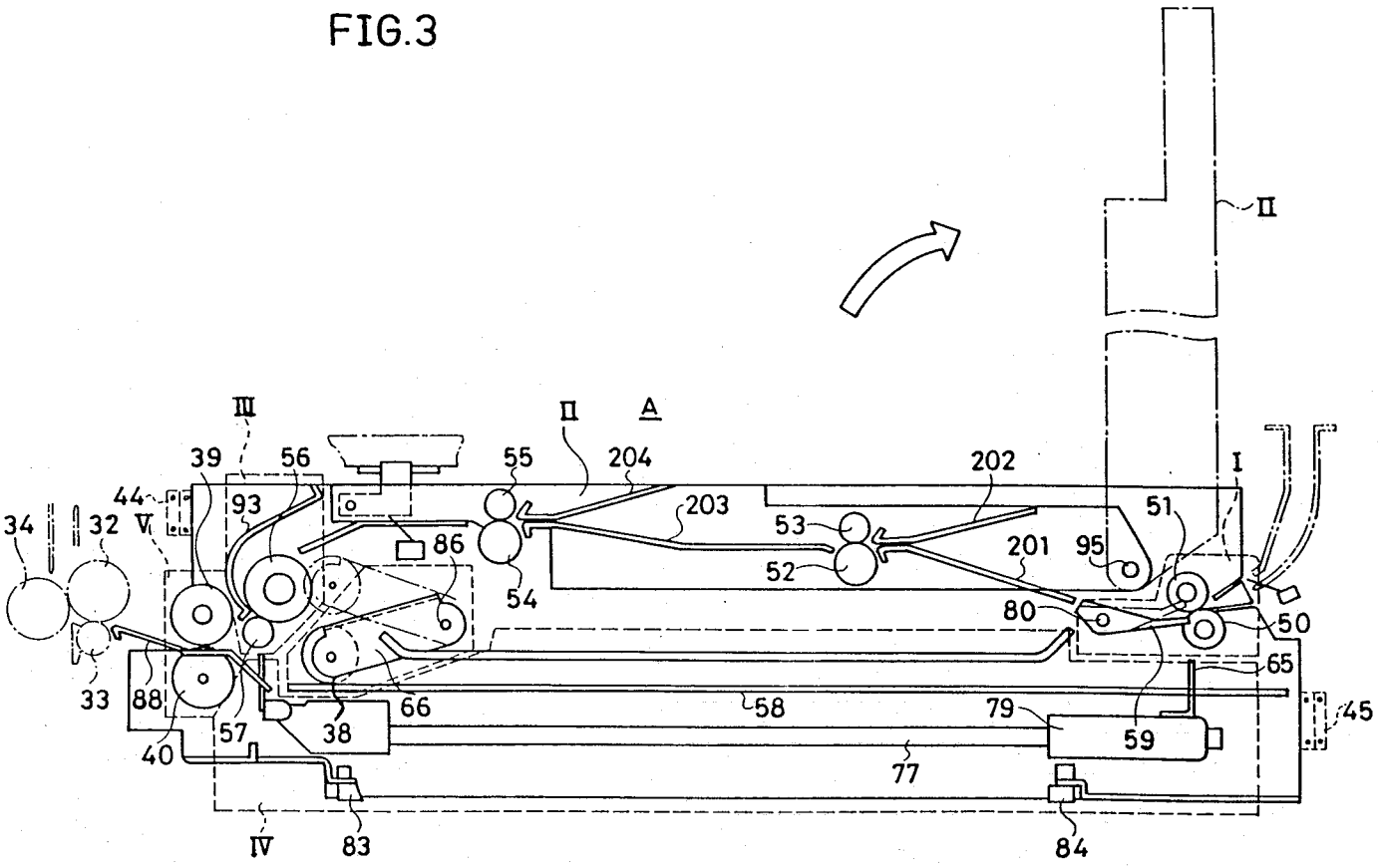
FIG. 3 is a cross sectional view in the direction of the line III—III of the intermediate tray unit shown in FIG. 1.

Another switching lever 59 is rotatable about the axis 80 as a fulcrum and, in duplex copying, it is set at a position shown by a solid line in FIG. 3. The copy paper is guided on the upper surface of the lever 59 and fed into the transport block II and guided by the guiding plates 201, 203 and 204 to be transported in the left side in FIG. 3 by the transport rollers 52, 53, 54 and 55. Thereafter, the copy paper is reversed by the reversing transport rollers 56 and 57 and a reversing guiding plate 93 and fed on the intermediate tray 58 with the copied side turned up. Then, it is aligned on the intermediate tray 58 and re-fed one by one by the rotation of the re-feeding roller 38 in the clockwise direction.

In the composite copying, the said switching lever 59 is set at a position shown by the chain-dotted line in FIG. 3. The copy paper is guided by the lower surface of the lever 59 immediately after its passage through the transport rollers 50 and 51, and fed in the intermediate tray 58 directly, with the copied side turned down. Thereafter, it is aligned on the intermediate tray 58 and re-fed one by one by the rotation of the re-feeding roller 38 in the clockwise direction as in the case of the said duplex copying.

The re-fed copy paper is delivered by the delivering rollers 39 and 40 and transported to the timing roller pair 13 through the said transport rollers 32, 33 and 34 and duplex copying or composite copying is carried out in the similar manner as the common copying operation described in the following. The re-feeding roller 38 is swingable and positioned at three steps with the support axis 86 of the holder 66 being the fulcrum (see the chain-dotted line, dotted line and solid line in FIG. 1.). When the copy paper is fed into the intermediate tray 58, the roller 38 is positioned at the upper stage or the intermediate stage, while in re-feeding, it is positioned at the lower stage to be in pressure contact with the copy paper aligned on the intermediate tray 58 with an appropriate pressure.

The operation of the regulating plates will be described with reference to FIGS. 3, 4 and 5. The regulating plate 63 is mounted on a sliding member 71 which is movable on the slide rail 72, the regulating plates 64 and 65 are mounted on slide members 73 and 79 movable on the slide rail 77 and they are independently driven by the stepping motors, respectively. The respective plates comprise respective home position sensors 85, 83, and 84 and these sensors 85, 83 and 84 detects (turns on) the return of each of the plates 63, 64 and 65 to the home position.

Figure 4:
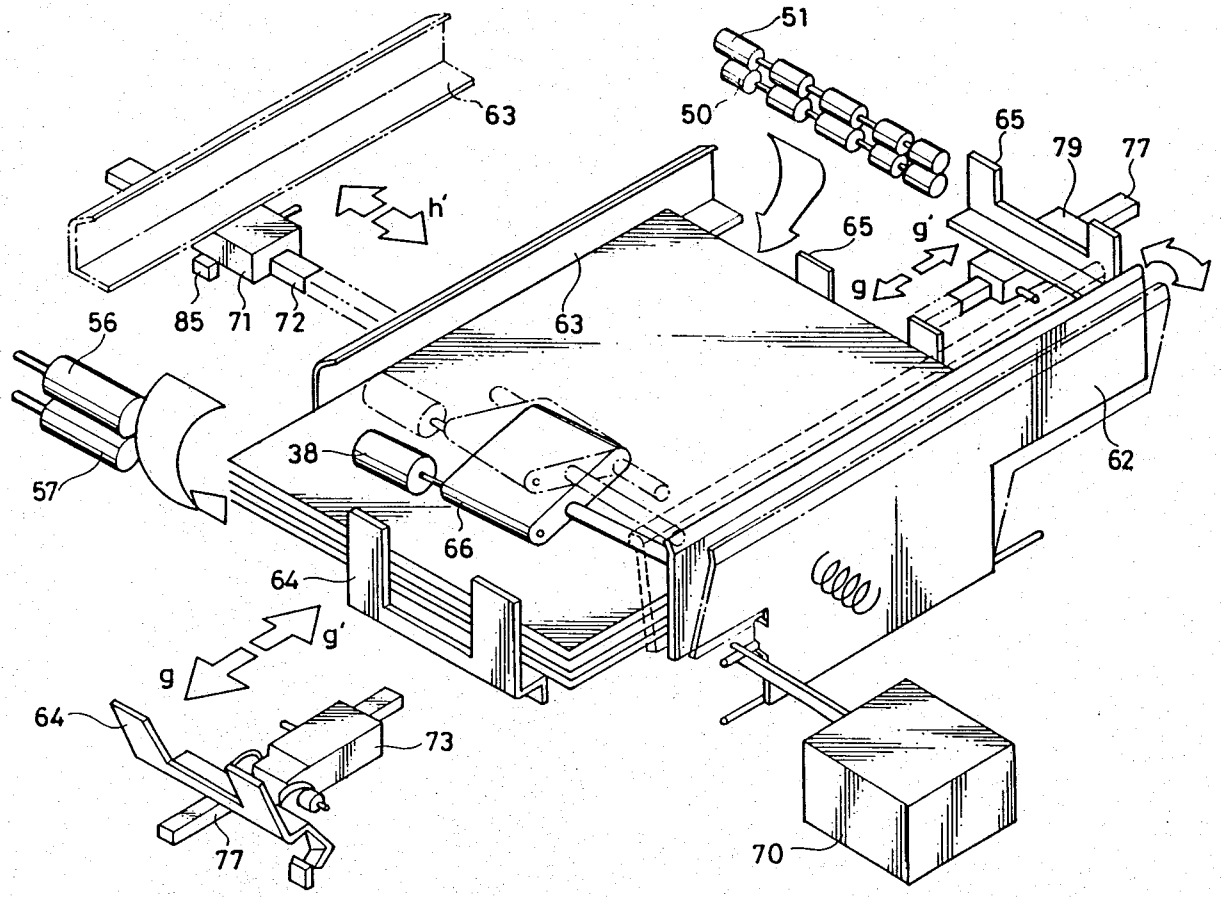
FIG. 4 is a perspective view of the intermediate tray portion of FIG. 1.
Figure 5:
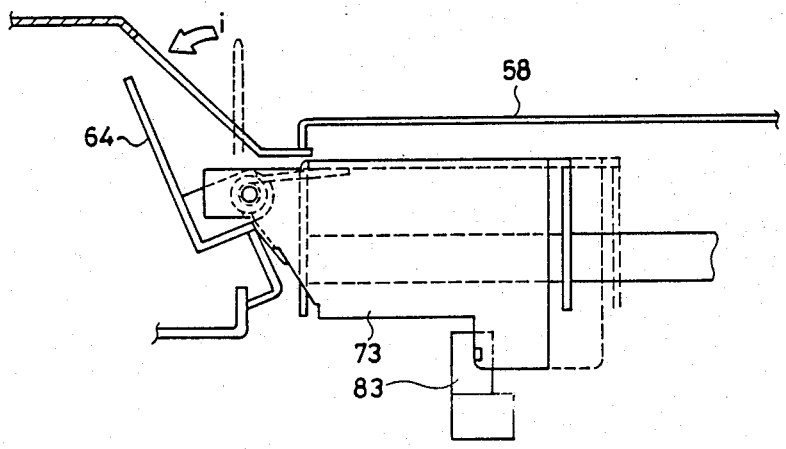
FIG. 5 is a side view of a main portion of FIG. 4.

The home position of the regulating plate 63 is the position shown by the chain-dotted line in FIG. 4, and, in the duplex/composite copying, it moves to the position corresponding to the size of the copy paper in the direction of an arrow h' by driving the stepping motor.

The home position of the regulating plate 64 is the vertical erected position shown in FIG. 4 and it waits at this position in the usual copying or at the duplex copying. In composite copying, the plate moves to the position corresponding to the size of the copy paper in the direction of an arrow g' by driving the stepping motor so as to regulate the edge of the copy paper fed on the intermediate tray 58 from the said transport rollers 50 and 51. In re-feeding, this regulating plate 64 is inclined in the direction of an arrow i as shown in FIG. 5 in order not to be obstructive to the movement of the copy paper.

The home position of the regulating plate 65 is also the vertical erected position shown in FIG. 4 and it waits at this position in the common copying or composite copying operation. In duplex copying, it moves to the position corresponding to the size of the copy paper in the direction of an arrow g by driving the stepping motor so as to regulate the edge of the copy paper fed on the intermediate tray 58 from the said reversing transport rollers 56 and 57.

After a prescribed number of the copy paper are contained and aligned in composite copying, the regulating plate 64 moves to the home position of the regulating plate 64 in the direction of the arrow g to be ready for the re-feeding of the copy paper.

Meanwhile, the regulating plate 62 is held at the erected position shown by the solid line in FIG. 4 in the widthwise, and it swings from the position of the chain-dotted line to the position of the dotted line every time the copy paper is contained one by one so as to align the contained copy papers. This swing is carried out with the help of a spring by driving the solenoid 70.

Meanwhile, when the duplex/composite copying mode is selected, the regulating plates 63, 64 and 65 move to the prescribed positions corresponding to the size of the copy paper. The distance of this movement is controlled based on the step number of each stepping motor and is regulated dependent on how many steps and in which direction each motor rotates with reference to each of the home position sensors 85, 83 and 84. Therefore, when each of the regulating plates 63, 64 and 65 is moved by external force other than the stepping motor, for example, manually moved by the operator, the control means can not determine the movement position as long as the sensors 85, 83 and 84 are off. Generally, such external force is exerted when the regulating plates 63, 64 and 65 are externally accessible, namely, when the unit A is drawn out of the body of the copying machine. In other words, when the unit A is drawn, there is a possibility of the regulating plates 63, 64 and 65 being moved. In that case, the above described control means can not determine whether the regulating plates 63, 64 and 65 are moved or not when the copying machine itself is reset.

Therefore, in this embodiment, when the unit A is drawn and then returned, each of the regulating plates 63, 64 and 65 is once returned to the home position and thereafter moved to the prescribed position. In this case, even if the unit A is in the process of containing or re-feeding the copy paper and the copy paper is on the intermediate tray 58, this copy paper is not an obstacle to the returning of the regulating plates 63, 64 and 65 to the home positions.

By the control as described above, the improper containing or improper re-feeding derived from the careless movement of the regulating plates 63, 64 and 65 can be surely prevented and the cause of jamming or skew can be eliminated. The control will be described in the following with reference to the flow charts of FIGS. 8, 9 and 10.

The relation of the arrangement of various operation keys and the like on the operating panel 300 on the body of the copying machine will be described with reference to FIG. 6.

On this operating panel 300, arranged are a print key 301 for starting the copying operation, a numeric value display device 302 capable of displaying numbers of two figures, ten keys 311 to 320 respectively corresponding to the numbers "1"·"2" . . . "9"·"0", an interruption key 307 for specifying interruption copying, a clear stop key 308, a copy paper size selection key 309 for selectively specifying either one of the containers 42 and 43, light emitting elements 309*a* to 309*d* for displaying the size of the copy paper contained in the selected container, up and down keys 305 and 306 for changing/specifying the density of the copy image on a step basis, a duplex copy selection key 303, a light emitting element 303*a* for displaying the duplex copying mode, a composite copying selection key 304 and a light emitting element 304*a* for displaying the composite copying mode, and so on.

Figure 7:
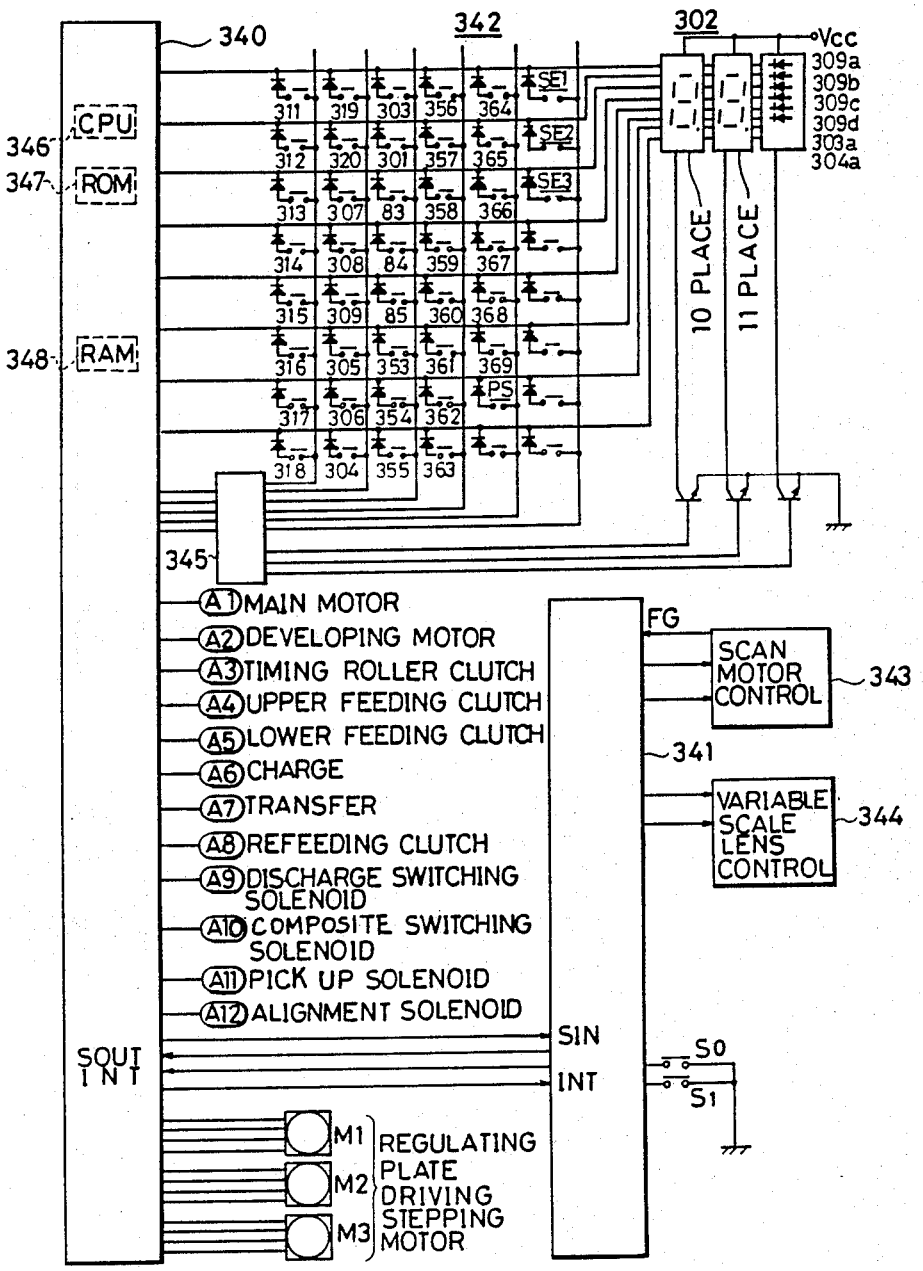
FIG. 7 is a control circuit in accordance with one embodiment of the present invention.

The switches corresponding to the various operation keys and various sensors provided on the body of the copying machine or on the intermediate tray unit A are related to the control circuit comprising a microcomputer system shown in FIG. 7.

The control circuit of the present copying machine will be described with reference to FIG. 7.

The control circuit is mainly comprised of a first microcomputer 340 for controlling the copying operation and a second microcomputer 341 for controlling the optical system connected to each other for the synchronization of each other. The first microcomputer 340 contains a CPU 346 functioning as the arithmetic portion, a ROM 347 for storing the operating program and so on of the CPU 346, a RAM 348 for temporarily storing various data, and so on, which are connected to each other. A switch matrix 342 with various operation keys and sensors on the operation panel 300 arranged vertically and horizontally is connected to the first microcomputer 340 and through the matrix 342 and a decoder 345, display device 302 and light emitting elements 309*a* to 309*d* and 303*a* and 304*a* are connected to the microcomputer 340. A main motor, a developing motor, a toner supplying motor, a feeding clutch, a re-feeding clutch, a switching solenoid of the levers 41 and 59 and so on are connected to the output terminals A1 to A12 of the first microcomputer 340 and, the stepping motors M1, M2 and M3 for driving the said regulating plates 63, 64 and 65 are connected to other output terminals, and the on and off of these elements are controlled based on a signal from the said switch matrix 342.

A driving control portion 343 of a direct current motor for scanning the optical system, the driving control portion 344 of the stepping motor for the various-scale magnification lens, a fixed position switch $S_0$ for the said optical system 1, a timing switch $S_1$ and so on are connected to the second microcomputer 341.

The control procedure for operating the above described control circuit will be hereinafter described with reference to the flow charts of FIGS. 8 to 11.

Figure 8:
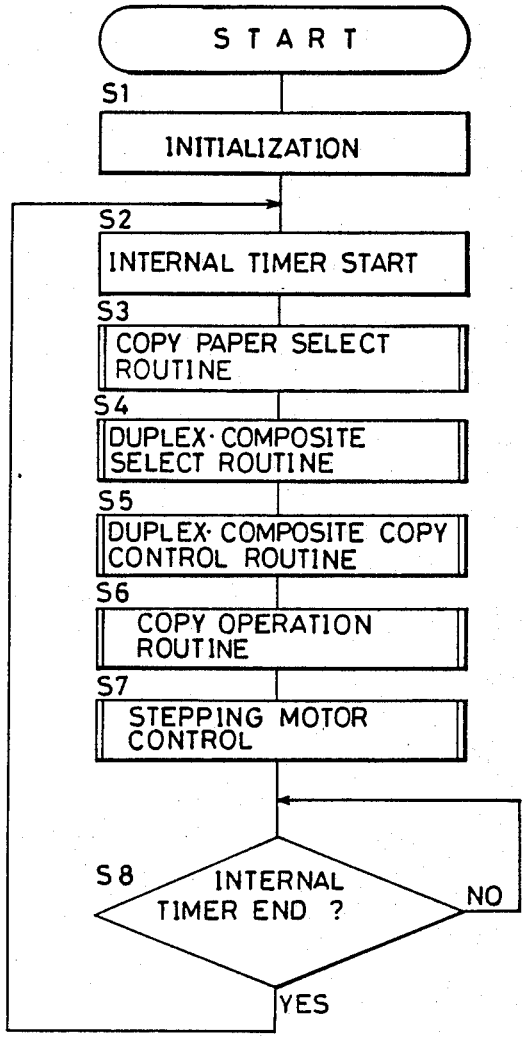
FIGS. 8, 9 and 10 are flow charts showing the control process in accordance with one embodiment of the present invention.

FIG. 8 shows the main routine of the control carried out by the first microcomputer 340. When the power switch PS is turned on and the CPU 340 is reset for starting, the CPU 340 is initialized at the step S1 and the initialization is effected to each of said devices at the initial mode.

Next, at step S2, the internal timer is started. This internal timer is set in the said step S1 and it determines the process time for one routine. The various timers described in the following subroutine determine the end of the set time by the routine count number.

Thereafter, each of the subroutines of the steps S3 to S7 are called successively, and when the processes of all subroutines are completed, the end of said internal timer is awaited at the step S8 to return to the said step S2.

The step S3 is the copy paper select routine for selecting the container of the copy paper while the step S4 is the duplex·composite copy select routine for carrying out the duplex copying or the composite copying. The step S5 is the duplex·composite copy control routine for operating the periphery of the intermediate tray 58 at the duplex·composite copying. The step S6 is the copying operation routine for carrying out the copying operation, the step S7 is a stepping motor control routine for driving the stepping motors for the regulating plates. The details of the control in the steps S3, S4, S6 and S7 are disclosed in Ito et al., U.S. Pat. No. 4,743,945 entitled "Copying Apparatus Which Forms Images Plural Times on the Same Copy Paper" filed on July 8, 1986, so that the description will be omitted.

Figure 9:
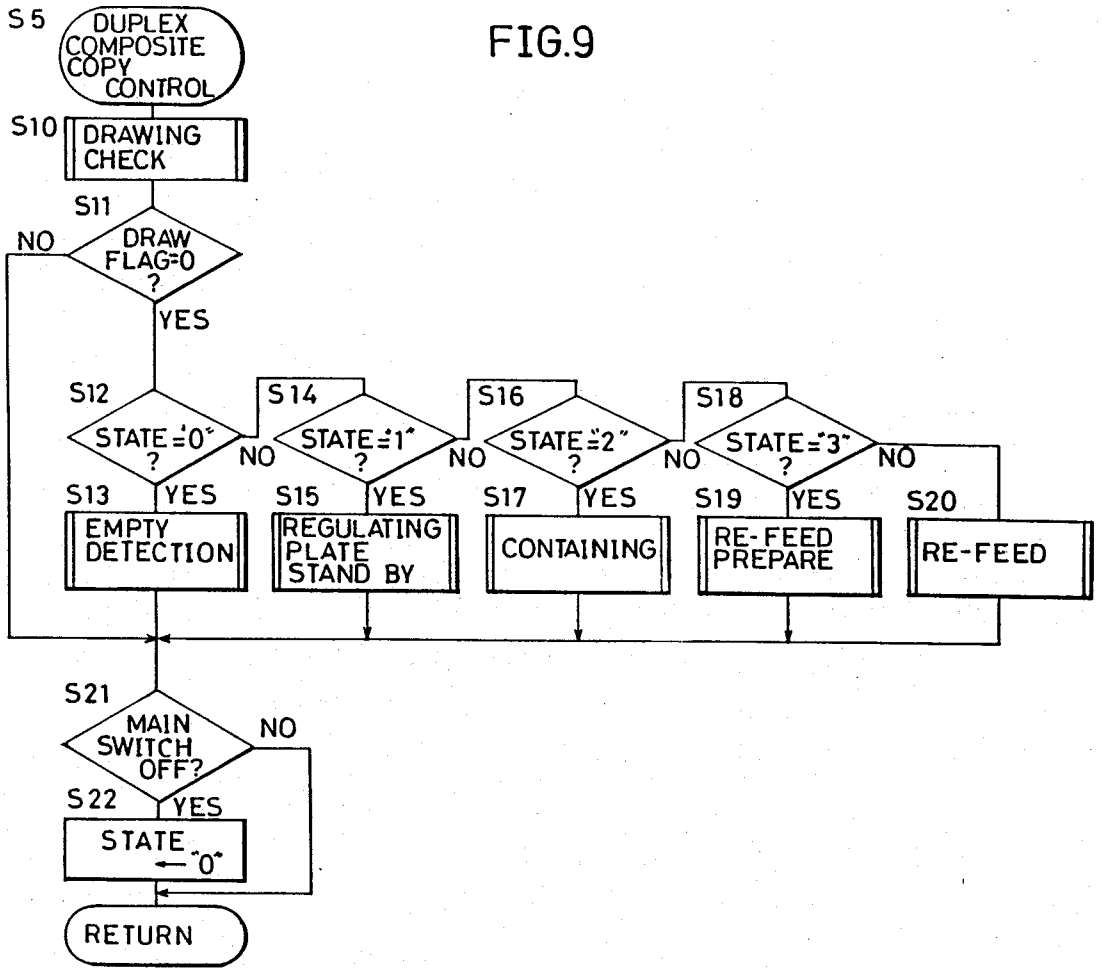

FIG. 9 shows the duplex-composite copy control routine effected in the step S5.

First, the subroutine (shown in FIG. 10) for checking the drawing is effected at step S10. At step S11, it is determined whether the drawing flag processed in that subroutine is "0" or not. This drawing flag is set "1" when the unit A is drawn out of the body of the copying machine. Therefore, if the drawing flag is "1", it directly proceeds to the step S21 and determines whether the main switch is off or not. If the switch is off, the state counter is reset at "0" at the step S22.

Meanwhile, if the drawing flag is determined to be "0" at the step S11, it is determined at the step S12 whether the state counter is "0" or not. If it is "0", it is determined in the step S13 whether there is a copy paper or not on the intermediate tray 58. If no copy paper is detected in this step, the state counter is incremented to "1", while if the existence of a copy paper is detected, all copy papers are discharged from the intermediate tray 58 to the tray 36 and, thereafter the state counter is incremented to "1". Thus, when the state counter is set at "1" and the determination of YES is given in the step S14, then each of the regulated plates 63, 64 and 65 is brought into the standby state at a prescribed position in the step S15. On this occasion, the stepping motors are driven dependent on whether the copying mode is the duplex copying or composite copying and on the size of the copy paper so as to move the said regulating plates 63, 64 and 65 to the prescribed positions for waiting. After the completion of the movement, the state counter is incremented to "2".

When the state counter is set at "2" and the determination of YES is given in the step S16, the copy paper is contained in the intermediate tray 58 in the step S17. On this occasion, the said regulating plate 62 is swung every time a copy paper is fed on the intermediate tray 58 so as to align the copy papers. When the containing-alignment of the last paper is finished, the state counter is incremented to "3".

Similarly, when the determination of YES is given in the step S18, the re-feeding is prepared in the step S19. When the preparation is completed, the state counter is incremented to "4". Thereafter, the determination of NO is given in the step S18 and the re-feeding roller 38 is rotated in the step S20 so as to re-feed the copy paper one by one from the unit A. When re-feeding of all copy papers is completed, the state counter is set at "1".

When each of the said steps S13, S15, S17, S19 and S20 is completed, it is determined in the step S21 whether the main switch is off or not and, if it is off, the state counter is reset at "0" in the step S22.

Figure 10:
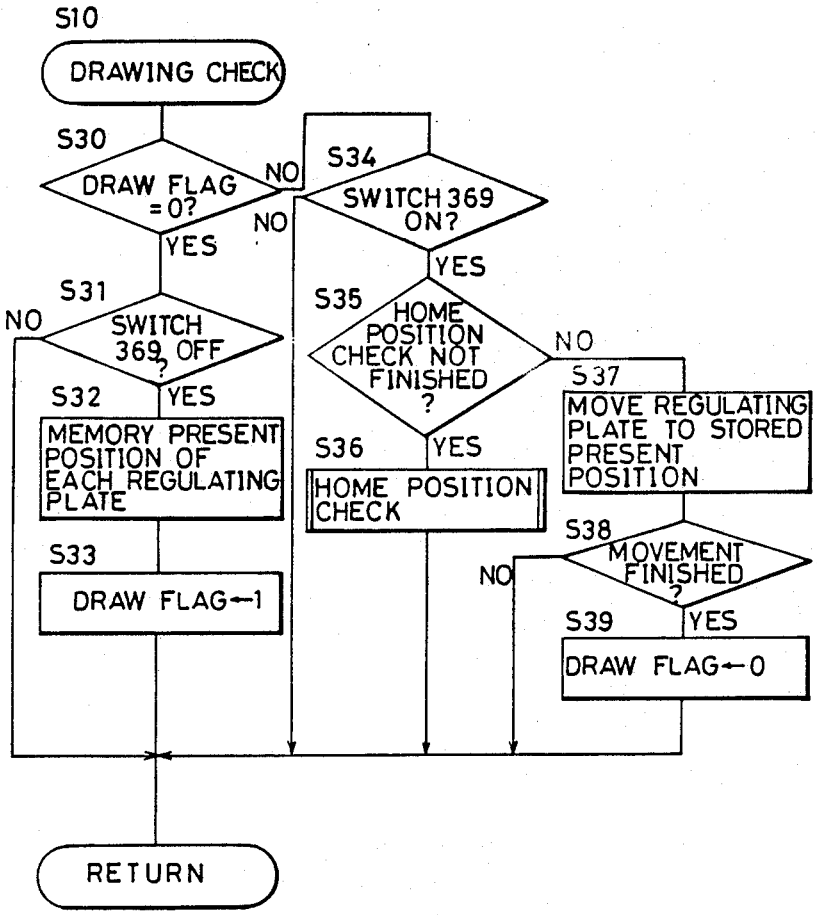

FIG. 10 shows a subroutine for checking the drawing carried out in the said step S10.

It is determined in the step S30 whether the drawing flag is "0" or not. The drawing flag is reset at "0" in initialization, and first it is determined to be "0" and in the step S31, it is determined whether the switch 369 for detecting the unit drawing is off or not. This switch 369 is in the on-state when the unit A is set in the body of the copying machine, and it is in the off-state when the unit is drawn out. Therefore, when the switch 369 is on, this subroutine ends immediately. Meanwhile, if the unit A is drawn out and the switch 369 is off, namely, if each of the regulating plates 63, 64 and 65 ar externally accessible, the positions of the regulating plates 63, 64 and 65 are stored in the step S32 and the drawing flag is set at "1" in the step S33.

Thereafter, when the step S30 is carried out, the determination of NO is given and it is determined in the step S34 whether the switch 369 is on or not. When the switch 369 is off, the unit A is still drawn out of the body, so that it returns to the main routine. When the switch 369 is switched on, namely, when the unit A is set in the body of the copying machine and the determination of YES is given in the step S34, it is determined in the step S35 whether the check is completed or not for determining the return of each of the regulated plates 63, 64 and 65 to the home position. If the plates are not yet returned to the home positions, i.e., (YES) in step S35, the home position check is carried in the step S36. Actually, each of the regulating plates 63, 64 and 65 is returned to the respective home positions.

When each of the regulating plates 63, 64 and 65 is returned to the home position and the determination of NO is given in the step S35, the regulating plates 63, 64 and 65 are moved to the present position stored in the said step S32 in the step S37. Thereafter, the completion of the movement is confirmed in the step S38, the drawing flag is reset at "0" in the step S39, thus ending this subroutine.

Meanwhile, the sheet container in accordance with the present invention is not limited to the above described embodiment and various modifications can be made within this scope of its spirit.

For example, as the means for detecting the switching of the regulating plates 63, 64 and 65 from the externally accessible state to the non-accessible state, although a switch 369 for detecting the drawing of the unit A is employed in the above described embodiment, a opening/closing detection switch of the front door of the body of the copying machine may be employed. Furthermore, regardless of the operation of the switches of this kind, the regulating plates 63, 64 and 65 may be controlled to return the home positions when the power is turned on assuming that the plates are externally accessible before the turning on of the power.

In addition, the present invention can be applied not only to the re-feeding device for duplex/composite copying but also to the devices such as finisher for binding the copied papers in the finishing step.

Although the present invention has been described and illustrate in detail, it is clearly understood that the same is by way of illustration and example only and is not to be taken by way of limitation, the spirit and scope of the present invention being limited only by the terms of the appended claims.

What is claimed is:

1. A copying device comprising sheet feeding means for feeding a sheet, image forming means for forming an image on the sheet fed from said sheet feeding means;

re-feeding means for re-feeding a sheet to said image forming means including a mounting plate for receiving the sheet with an image formed thereon by said image forming means, a regulating plate having an initial position and regulating the position of the sheet mounted on said mounting plate, a moving mechanism for moving the regulating plate to the position corresponding to the size of the sheet; and re-feeding mechanism for re-feeding the sheet on said mounting plate to said image forming means;

a frame for holding at least said re-feeding means, a drawing mechanism for freely drawing said re-feeding means from said frame, first detecting means for detecting the size of the sheet fed from said sheet feeding means, first control means for controlling said moving mechanism in response to the detection output of said first detecting means, second detecting means for detecting the drawing and attachment of said re-feeding means by said drawing mechanism, and second control means for controlling in response to the detection output of the attachment of said re-feeding means by said second detecting means for once returning said regulating plate to said initial position and thereafter moving the same to the position corresponding to the size of the sheet.

2. A copying device according to claim 1, which further comprises memory means for storing the position of said regulating plate when said re-feeding means is drawn out of said frame by said drawing mechanism, wherein said second control means controls said moving mechanism according to the contents stored in said memory means.

3. A copying device according to claim 1, wherein said re-feeding means further comprises first transport means for transporting a sheet with an image formed thereon to be contained in said mounting plate with the image turned up, and second transport means for transporting a sheet with an image formed thereon to be contained in the mounting plate with the image turned down.

4. A copying device according to claim 1, which further comprises third detecting means for detecting the presence of a sheet in said re-feeding means, and discharging means for discharging the sheet in said re-feeding means out of said frame in response to the output of the attachment of said re-feeding means by said second detection means and in response to the output indicating the existence of a sheet by said third detecting means.

5. A copying device comprising sheet feeding means for feeding a sheet;

image forming means for forming an image on the sheet fed from said sheet feeding means;

re-feeding means for re-feeding a sheet to said image forming means including, a mounting plate for receiving a sheet with an image formed thereon by said image forming means, a regulating plate having an initial position and regulating the position of the sheet mounted on said mounting plate, moving mechanism for moving the regulating plate to the position corresponding to the size of the sheet, and re-feeding means for re-feeding the sheet on said mounting plate to said image forming means;

detecting means for detecting the size of the sheet fed from said sheet feeding means;

first control means for controlling the moving mechanism in response to the detection output of the detection means;

a power switch;

second control means for controlling said moving mechanism in response to the turning on of said power switch for once returning the regulating plate to said initial position and thereafter moving the same to the position corresponding to the size of the sheet.

6. A copying device comprising sheet feeding means for feeding a sheet, image forming for forming an image on the sheet fed from said sheet feeding means, re-feeding means for receiving the sheet with an image formed thereon by said image forming means and for re-feeding the same to said image forming means, a frame for holding at least said re-feeding means, a drawing mechanism for freely drawing said re-feeding means from said frame, first detecting means for detecting the existence of a sheet in said re-feeding means, second detecting means for detecting the drawing and attachment of said re-feeding means by said drawing mechanism, and discharging means for discharging the sheet in said re-feeding means out of said frame without the operation of said image forming means in response to the detection output of the attachment of said re-feeding means by said second detecting means and in response to the detection indicating the existence of the sheet by said first detection means.

7. A sheet container detachable to an image forming device for containing a sheet with an image formed thereon by said image forming device, comprising sheet mounting means for mounting a sheet, sheet regulating means having an initial position, regulating the position of the sheet mounted on said sheet mounting means, and being movable to the position corresponding to the size of the sheet contained, driving means for moving said sheet regulating means to the position corresponding to the size of the sheet contained, detecting means for detecting the attachment/detachment of said sheet container to said image forming device, and control means for controlling said driving means in response to the detection output of the attachment of said sheet container by said detecting means for once returning the sheet regulating means to said initial position and thereafter moving the same to the position corresponding to the size of the sheet.

8. A sheet container for containing a sheet with an image formed thereon by an image forming device comprising sheet mounting means for mounting a sheet, sheet regulating means having an initial position, regulating the position of the sheet mounted on said sheet mounting means, and being movable to the position corresponding to the size of the sheet contained, driving means for moving said sheet regulating means to the position corresponding to the size of the sheet contained, power supply means for supplying power, and control means for controlling the driving means in such a manner that said sheet regulating means is returned to said initial position when the power is supplied by said power means and thereafter the same is moved to the position corresponding to the size of the sheet.

9. In a copying device having sheet feeding means for feeding a sheet, image forming means for forming an image on the sheet fed from said sheet feeding means, re-feeding means for once receiving the sheet with an image formed by said image forming means and re-feeding the same to said image forming means, said re-feeding means including a sheet regulating plate being movable from an initial position to a regulation position for regulating the position of the received sheet and a moving mechanism for moving the regulating plate, said re-feeding means being entirely removable from a frame of the copying device, and detecting means for detecting the attachment of said re-feeding means to the frame, and controlling means for controlling the copying device, the method for controlling the copying device comprising the steps of:

detecting the attachment of said re-feeding means to the frame; and returning said regulating plate to said initial position in response to the detection of the attachment and thereafter moving the same to said regulating position.

10. In a copying device having sheet feeding means for feeding a sheet, image forming means for forming an image on the sheet fed from said sheet feeding means, re-feeding means for once receiving the sheet with an image formed by said image forming means and re-feeding the same to said image forming means, said re-feeding means including a sheet regulating plate being movable from an initial position to a regulation position for regulating the position of the received sheet and a moving mechanism for moving the regulating plate, said re-feeding means being entirely removable from a frame of the copying device, and detecting means for detecting the attachment of said re-feeding means to the frame, detecting means for detecting existence of the sheet in the re-feeding means and controlling means for controlling the copying device, the method for controlling the copying device comprising the steps of:

detecting the attachment of said re-feeding means to the frame;

detecting the existence of the sheet in the re-feeding means; and re-feeding the sheet existing in the re-feeding means to said image forming means without accompanying image formation in response to the detection of the attachment of said re-feeding means when the sheet exists in the re-feeding means.

11. In a copying device having sheet feeding means for feeding a sheet, image forming means for forming an image on the sheet fed from said sheet feeding means, re-feeding means for once receiving the sheet with an image formed by said image forming means and re-feeding the same to said image forming means, said re-feeding means including a sheet regulating plate being movable from an initial position to a regulating position for regulating the position of the received sheet and a moving mechanism for moving the regulating plate, power supply means for supplying power to the device and controlling means for controlling the copying device, the method for controlling the copying device comprising the steps of:

detecting the initiation of power supply from the power supply means; and returning said regulating plate to said initial position in response to the detection of the initiation of the power supply and thereafter moving the same to said regulating position.

* * * * *